United States Patent [19]

Reil

[11] Patent Number: 5,020,986

[45] Date of Patent: Jun. 4, 1991

[54] APPARATUS FOR CONVEYING A SLEEVE WHICH IS CLOSED AT ONE END OUT OF A PROCESSING STATION AND INTO TRANSPORTER MEANS

[75] Inventor: Wilhelm Reil, Bensheim, Fed. Rep. of Germany

[73] Assignee: Die Tetra Pak Rausing & Co., Pully, Switzerland

[21] Appl. No.: 339,296

[22] Filed: Apr. 17, 1989

[30] Foreign Application Priority Data

May 14, 1988 [DE] Fed. Rep. of Germany ..... 3816542

[51] Int. Cl.[5] ..... B29C 45/42; B29C 45/43; B31B 1/28

[52] U.S. Cl. ..... 425/437; 425/556; 264/335; 413/105; 413/472

[58] Field of Search ..... 264/334, 335; 425/436 RM, 437, 438; 493/85, 105, 472

[56] References Cited

U.S. PATENT DOCUMENTS

| | | | |
|---|---|---|---|
| 2,234,044 | 3/1941 | Emmer | 425/436 RM |
| 2,727,444 | 12/1955 | Wethe | 493/472 |
| 2,737,090 | 3/1956 | Nordquist | 493/472 |
| 2,835,371 | 5/1958 | Davis | 198/24 |
| 2,929,105 | 3/1960 | Starck et al. | 425/437 |
| 3,145,240 | 8/1964 | Proulx et al. | 264/335 |
| 3,332,325 | 7/1967 | Garwood | 493/472 |
| 3,382,774 | 5/1968 | Hoff | 493/472 |
| 3,618,481 | 11/1971 | Odenhagen | 493/472 |
| 3,853,451 | 12/1974 | Bendzick | 425/438 |
| 4,364,895 | 12/1982 | Underwood | 425/438 |
| 4,660,801 | 4/1987 | Schad | 425/437 |

FOREIGN PATENT DOCUMENTS

| | | |
|---|---|---|
| 1832766 | 4/1961 | Fed. Rep. of Germany . |
| 2006665 | 9/1970 | Fed. Rep. of Germany . |
| 2728990 | 1/1979 | Fed. Rep. of Germany . |
| 3323190 | 1/1985 | Fed. Rep. of Germany . |

*Primary Examiner*—William E. Terrell
*Attorney, Agent, or Firm*—Austin R. Miller

[57] ABSTRACT

The invention describes a method of conveying a sleeve (1) which is closed at one end and which consists of paper from a machining station (3) into a transporter. In order to be able to convey such sleeves into the transporter in a short time, even when the sleeves (1) are closed at one end by the integral moulding of a lid (2), it is according to the invention provided that the sleeve (1) be gripped at its edges (5) which are at the rear in the direction of movement (7) so that the sleeve is pushed in the direction of its longitudinal axis and on a straight path into the transporter, air being blown into the interior (16) of the sleeve (1). To this end, a scraper (4) is used which is adapted for translatory movement.

5 Claims, 5 Drawing Sheets

APPARATUS FOR CONVEYING A SLEEVE WHICH IS CLOSED AT ONE END OUT OF A PROCESSING STATION AND INTO TRANSPORTER MEANS

The invention relates to a method of conveying a sleeve which consists of paper, cardboard or the like and which is closed at one end, out of a processing station and to a transporter means and it also relates to an apparatus which is suitably constructed to carry out such a method.

In the packaging industry, packages are known for holding liquids and which are sleeve-like, being closed at one end by an end face which will subsequently form the bottom or the lid. When such liquids packagings are produced, generally there is the difficulty of handling them during manufacture, filling and sealing. Usually, packagings which are filled with liquids are produced in the following sequence, the first stage in fact being the shaping of the sleeve which is mostly produced from paper coated on both sides with synthetic plastics materials, after which the sleeve is sealed at one end, then filled, sealed at the opposite end and finally passed to a re-packing unit.

The present invention is concerned with the stage in manufacture which follows the sealing of the sleeve at one end and up to the time it is passed to a filling station.

In another connection, it is already known for a tubular or cylindrical sleeve-like member to be formed from a web of paper drawn off a supply roller and which is coated at least on one side with synthetic plastics material to render it fluid-tight, the sleeve being mostly formed by the application of a longitudinal seam on a cut-off portion of the web, the height or width of this part being equal to the length of the longitudinal sealing seam.

It is furthermore known for such a tube or sleeve which is initially open at both ends to be sealed at one end, namely at the end which will subsequently form the lid, with a synthetic plastics material without a backing material, in that the paper sleeve is pushed sufficiently far onto a mandrel that along the edge of the paper tube which is disposed at the free end of the mandrel and which, furthermore, is no longer coated with synthetic plastics material, due to the cutting operation, that member which will subsequently be the lid and which preferably has a pourer orifice, can be integrally injection moulded in fluidtight manner. Such a sleeve which has been closed at one end is then pulled off the mandrel, conveyed by transporter means to the filling station where it is filled, sealed at the end opposite the lid and then further processed in the usual manner.

The present invention is concerned with the scraping or removal of the sleeve from the mandrel and its Insertion into the transporter means which when horizontally transports in the direction of conveyance the sleeve which is generally closed at one end and which is in an upright position to allow liquid to be poured into it vertically from above.

After the synthetic plastics lid has been injection moulded onto the sleeve, it is difficult for the resulting sleeve to be withdrawn quickly from the mandrel. Even if the sleeve were not seated on a mandrel, it would be difficult to convey it in a short time from a processing station in which, for example, the lid was injection moulded into place, into the transporter means. Naturally such conveyance is basically possible and in one case or another it may even have been carried out by per se known means within the state of the art. However, if liquids packagings are produced from the web at high speed and at a high rate of production, then it is necessary to provide a method and an appropriate apparatus by which transfer from the processing station to the transporter means can take place in a very short time. In fact, it is only possible then for the large quantity of completed packagings to be produced per unit of time. The output of such a packaging production machine (number of packagings per unit of time) will always depend upon that stage in the procedure or apparatus where a bottleneck is encountered from time to time.

In the state of the art, it was difficult adequately to grip the package at its rear edge, i.e. the edge opposite the moulded-on lid or end member or alternatively to clamp the package at some other location and move it from the processing station into the transporter means by positive or frictional action.

This problem is rendered particularly difficult by the fact that the sleeve is closed at one end. If the sleeve is supported from the inside, generally if it is carried by a mandrel, then the man skilled in the art will immediately appreciate the difficulty that when the sleeve is stripped from the mandrel, a space must be created between the end of the mandrel and the sleeve, this space becoming progressively larger during conveyance or during removal from the mandrel so that a vacuum is formed in this space unless air is able to flow in from the outside.

It was thought that a paper sleeve pushed over the periphery of the mandrel and in the direction of the longitudinal axis of the mandrel would only have to be seated loosely enough that air flowing in during extraction would prevent the formation of the vacuum. However, this solution was found to be inappropriate because when the sleeve, and thus also its edge on which the synthetic plastics lid is to be injection moulded without any carrier material, is too loosely seated on the mandrel so that when the synthetic plastic is injected, the plastic material is forced into the gap which is made loosely possible, the packing is not only unsightly but also leaks.

Therefore, the invention is based on the problem of providing a method of conveying a sleeve which is closed at one end and which has the features mentioned at the outset, and also of providing an apparatus for carrying out such a conveying method, by means of which, in spite of the evident difficulties, it is possible in a very short time to convey sleeves from a processing station to a transporter means, even in the case of paper sleeves which are closed at one end by the injection moulding of a lid.

With regard to the method, the problem is according to the invention resolved in that the sleeve is gripped at its edges which are at the rear in the direction of movement and is pushed in the direction of its longitudinal axis along a straight path and into the transporter means, air being blown into the interior of the sleeve. The idea according to the invention lies in the gripping of the sleeve at its edges which are at the rear in the direction of movement, in other words those edges which are opposite the sleeve closure. In other words, where the sleeve is open and can be subsequently filled, that is where the sleeve is gripped and moved by a kind of positive engagement in the direction of its longitudinal axis. In this direction, and it is in this that the second consideration of the invention resides, the sleeve offers its greatest strength and also stability of shape. In this way, sufficient force can be exerted on the paper sleeve to accelerate its movement so that the acceleration is great enough and conveyance from the processing station to the transporter means will occur with sufficient speed. Furthermore, so that the movement in the direction of the transporter means is still further favoured, air is blown into the interior of the sleeve. A pressure or a cushion of air is therefore built up behind the end face which will hereinafter be referred to as the lid, and this helps to move the sleeve in its direction of progress.

According to the invention, it is furthermore advantageous if the sleeve is only gripped on a part of its rear edge which represents not more than half thereof, by a scraper which is in its starting position and is pulled down from a mandrel which is carrying it and which is in the starting position, whereupon the scraper moves back to its starting position alongside the next sleeve. While the sleeve can be gripped anywhere while it is being pushed onto the mandrel, so that there can scarcely be any problem pushing the sleeve onto the mandrel with considerable speed, scraping off is a substantially greater problem because the rear end is situated close to the mandrel and a man skilled in the art would usually doubt that this could be the sole possibility of removal. According to the invention, however, a purely frictional engagement is avoided by the fact that the sleeve is gripped around its periphery. Despite these doubts about gripping only over the rear edge, the invention proposes that the scraper actually be applied to this rear edge and can transmit sufficient forces to accelerate movement of the sleeve in the direction of the transporter means.

For the case mentioned here where the sleeve is carried by a mandrel, a particularly practical embodiment is one in which this mandrel serves as the interior mould for an injection moulding apparatus (processing station), while the outer mould, preferably in two parts, is moved from outside the sleeve and against the end face of the mandrel where it is moved into a suitable position, a process which results in closure of the injection moulding space. When the outer mould has been opened, the paper sleeve, closed at one end, is to be found on the mandrel which carries it, and this position is termed the starting position because in the case of the present invention it is concerned with movement from the mandrel into the transporter means. The "pulling down" of the sleeve from the mandrel, described with the aforementioned features, can of course also be described as a "pushing down", according to the point from which the movement is observed.

It will be understood that a scraper has to be moved over the sleeve seated on the mandrel in order to be able to reach and grip the rear edge of the sleeve and that during the pushing of the sleeve downwards from the mandrel, it must sufficiently travel past the mandrel for the rear edge of the paper sleeve also to move clear of the mandrel.

If, in per se known manner, a mandrel wheel is used, from which a plurality of mandrels project radially outwardly in a stellate fashion, then after the scraper has been moved away from the mandrel, this latter can be moved out of its so-called starting position into a further position which is of no interest for the invention. In the case of such a mandrel wheel or even if a next mandrel with a freshly moulded-on lid attached to the paper sleeve is brought into position, then this next mandrel will again be in its starting position. In the meantime, the scraper ought as far as possible to return to its own starting position.

To a man skilled in the art, once the first empty mandrel has moved away, it will be obvious initially to wait until the second mandrel carrying a sleeve which is closed at one end is again in the starting position before moving the scraper back into its starting position. This position must be considered to be that whence, shortly after it starts moving, the scraper is capable of engaging the rear edge of the sleeve. At the same time, it will however be appreciated that valuable time in the working rhythm of the packaging machine will have been wasted. According to the invention, the above-mentioned feature is mentioned for the reason that the sleeve is, in fact, not gripped by the scraper over its entire rear edge but only on a portion of it which does not amount to more than half. The doubts of a man skilled in the art ought to be the more marked for this feature, because the total force, and thus the pressure on the rear edge for pulling the sleeve off the mandrel with sufficient acceleration, has to be transmitted to the sleeve material via just a fraction of the rear edge. However, according to the invention it has been found that such a solution might well be considered, particularly if suitable conveying means are provided, as will be described hereinafter.

The surprising advantage which is achieved by the fact that the rear edge of the sleeve is only partly gripped, lies in a saving of time. In fact, whereas after it leaves the first empty mandrel, the second mandrel with the next closed sleeve is moved into its (for scraping) starting position, it is now according to the invention possible for the scraper already to be moving into its starting position while the mandrel has still not reached its starting position. Preferably, the mandrel with the next sleeve reaches its starting position when the scraper is also substantially in its starting position. Minor differences in timing can be overlooked.

Expediently, the invention is further implemented in that after the sleeve has been pulled from the mandrel, this empty mandrel is moved away out of its starting position, a new mandrel being moved into the starting position, together with a sleeve. These features make it possible to achieve the particularly short time before both the parts which engage each other, namely the scraper and the sleeve, are back in their respective starting positions. The working rhythm of the production machine can thus be shortened so that the rate of output of the packaging machine can be increased.

With regard to the apparatus for conveying a sleeve which consists of paper, cardboard or such like, from a processing station to a transporter means, the aforementioned problem can be resolved in that a scraper which is adapted to be brought into engagement with that edge of the sleeve which is at the rear in the direction of conveyance, is adapted to be driven with a translatory movement. According to the invention, the scraper is moved on a straight path from a starting position into an extreme position and back. From the mechanical point of view, such a movement can be carried out particularly quickly and furthermore, the possibility of the scraper acting on the rear edge of the sleeve is encouraged, because the direction of translatory movement coincides with the longitudinal axis of the sleeve, i.e. with the direction in which the stiff paper is made available.

It is particularly preferred if, according to the invention, the scraper is mounted on a lifting rod adapted to move in the direction of its longitudinal axis and is V-shaped, when viewed in the direction of this longitudinal axis. The lifting rod makes it possible to carry out a rapid translatory movement in its longitudinal axis and therefore the scraper is supported and moved via a lifting rod.

If it is intended to convey round and preferably cross-sectionally circular paper sleeves in the manner indicated according to the invention, then the scraper should be formed to match the sleeve periphery or the shape of the rear edge of the sleeve, in other words it should be round. However, it is also conceivable for a sleeve to have a rectangular or quadratic cross-section. In this case, it has been found that scraping is possible over two of the four edges, so that the scraper acquires a V-shape. This configuration of scraper provides the advantage already mentioned earlier that in fact after movement of the first empty mandrel away from the site, when the scraper is in the extreme position, the second mandrel which carries a further sleeve can be moved into its starting position, while at the same time the scraper is returned to its starting position. In the case of a preferred special embodiment, if it is imagined that the angle enclosed by the V is set at about 90° or more, then it is at the same time evident that the V—always as seen in the direction of the longitudinal axis of the lifting rod—provides a space which is only half enclosed, or even less, while on the opposite side, preferably the side opposite the tip or edge of the V, the space is open and in fact in this open space the second mandrel should, according to the invention, carry the next sleeve into position, even if the V is already there and even if the scraper which is V-shaped when viewed in the said direction, is already on its way back to its starting position or is already in its starting position. The second mandrel which carries the next sleeve ought as far as possible to be moved quickly into its starting position and by virtue of the V-shaped construction of the scraper, it should be capable of achieving this initial position without regard to the location of the scraper. Evidently, the output of the machine can consequently be considerably increased.

According to the invention, it is furthermore advantageous if the scraper comprises an angular carrier which mounts spring loaded gripper blocks adapted for movement in a direction at right-angles to the inner edge on the two mutually facing inner edges of the V. The carrier represents the rigid supporting part of the scraper which can be moved in a translatory sense rapidly and in a brief sequence via the lifting rod. However, is generally extremely difficult, with an accuracy of millimeters or possibly tenths of a millimeter, to move such a rigid part up to a relatively quickly moving mandrel in such a way that the rear edge of a paper sleeve can be reliably and securely gripped, particularly if only a part of the total available rear edge is to be gripped by the scraper. Without the gripper blocks which are adapted to be movable according to the invention, such a scraper would be virtually unfeasible. According to the invention, however, preferably one gripper block is spring loaded and movable preferably on each inner edge in such a way that the tolerances which have just been mentioned can be easily bridged. It is favourable if the gripper block is produced for instance from a material which is softer than the mandrel or the carrier. While the mandrel, the carrier, the lifting rod and other parts of the machine are produced from steel, aluminium, brass or other suitable alloys, synthetic plastics material should be used for the gripper blocks, and Teflon in particular would be an expedient choice. This has certain self-lubricating properties and so makes it possible for the front edges of the gripper blocks which face the lifting rod possibly to slide along the surface of the mandrel so that when they are in their starting position, they are reliably in contact with the mandrel which is in its starting position. Then, in fact, it is reliably ensured that upon switch-over of the translatory direction of movement, those edges of the gripper blocks which face the relevant mandrel will form-lockingly engage the rear edge of the sleeve.

In the case of a sleeve which is of quadratic cross-section, the carrier of the scraper takes the form of an angle member, the two arms of the V forming the angle matching the cross-sectional shape of the sleeve. This applies both to sleeves having a parallelogram-like, trapezoidal, rectangular or also quadratic cross-section, to mention only a few examples. Preferably, sleeves with a quadratic cross-section are used, so that the angle between the two arms of the V amounts to 90°. Then also the two inner edges of the carriers are at 90° to each other. These are termed the "mutually facing" inner edges. Viewed in the direction at right-angles to the longitudinal axis of the lifting rod, they have a certain flatness into which a recess is machined, so providing within the carrier and behind the respective inner edge a space in which the gripper blocks are not only accommodated but are also capable of movement. Preferably, each gripper block is adapted for movement or displacement in relation to the inner edge of the carrier and preferably only one gripper block is disposed behind each inner edge of the carrier.

For easier manufacture of the carrier, this latter can be milled out from its surface (at right-angles to the inner edge), in order to provide the space to accommodate the gripper block. If the gripper block is introduced into this space, two guide pins fixed in the carrier at a distance from each other engaging elongated holes in the gripper block so that they can guide it, then one surface of the gripper block bears on the supporting surface of the carrier which is on the inside of and parallel with the outer surface of the carrier which extends at a right-angle to the longitudinal axis of the lifting rod, while the opposite surface of the gripper block is flush alongside the "bottom" surface of the carrier, which is opposite the first-mentioned surface when one looks in the direction of the longitudinal axis of the lifting rod from its free end and in the direction of its attachment. Accommodating the gripper block in the space in the carrier behind the relevant inner edge of the carrier is then expediently achieved by a retaining plate which is fixed by screws on the "bottom" surface of the carrier. In consequence, the space in the carrier behind the relevant inner edge is sealed on five of its six sides (if it is regarded as rectangular or parallelepiped).

For it to function, the gripper block must project from the surface of the carrier, where the inner edge is provided, i.e. that face of the V-shaped carrier which is opposite the adjacent surface. Therefore, we speak here also of "mutually facing inner edges". These inner edges or the mutually facing gripper blocks are in plan view, i.e. when one looks in the longitudinal axis of the lifting rod from its free end in the direction of its attachment, closed in a V-shape on one side, the point of the V being imagined, and they are so open on the other opposite side that during the translatory movement of the carrier, together with its gripper blocks, any desired part of the machine or also the workpiece could be moved into (or possibly also out of) place, notwithstanding the position of the carrier.

Upon withdrawal of a paper sleeve from a mandrel, the paper sleeve being closed at one end, mention was already made at the outset of the difficulty that a vacuum might form if the sleeve is withdrawn from the mandrel very quickly. In order to counteract this difficulty, it is according to the invention envisaged that the mandrel comprise interior air passages and an insert which forms an air outlet. So that the mandrel can be used in the likewise above-mentioned manner as the internal mould in a synthetic plastics injection moulding apparatus, it must have a closed end face and in the case of a mandrel wheel, this should preferably be at its free end. In order to dissipate the vacuum which forms when the paper sleeve is withdrawn from the mandrel, air is blown over the end face behind the lid of the paper sleeve. For this purpose, an air outlet is required in order to feed air to the air passages inside the mandrel. Since the synthetic plastics material for forming the lid on the paper sleeve is injected at high pressure and at a high temperature, the air outlet ought not to be of large dimensions. In practice, it has been found that the gap for the exit of air ought not to be greater than 0.05 mm but should as far as possible be narrower or smaller. The difficulties which a man skilled in the art would envisage in setting up such small air outlet slots are overcome according to the invention by the provision of an insert. From the mechanical point of view, it is possible in fact to drill inside the mandrel suitably large air passages (long enough and of sufficient diameter) and then it is possible to provide a space in the form of a blind bore which is connected to these air passages, preferably starting from the closed end face of the mandrel and into which the insert is fitted, which is, for example, constructed like a plug, leaving the necessary narrow gap free.

In this respect, it is expedient for the gap to be constructed in the form of a plurality of concentric circles or for it to be circular with a width of less than 0.05 mm. Consequently, the emergence of air can be made suitably narrow and nevertheless the overall area of the air outlet can be made sufficiently large. In the case of a liquids packaging with a capacity of 1 liter, it is in fact in the case of a special embodiment of a packaging machine, desirable for the essential part of the paper sleeve to be withdrawn from the mandrel in a half a second or less. However, this means that in a period of 0.6 to 0.3 seconds and preferably 0.4 or 0.5 seconds, a liter of air has to be blown through the air outlet on the insert or in the case of the imaginary preferred embodiment, through the circular slit which is 0.03 mm wide, into the space behind the sleeve. The details of figures and sizes will, to a man skilled in the art, make it obvious what advantages can be achieved by the measures according to the invention.

At the outset, reference was made to the advantage which arises in terms of simplification of the injection moulding tool by reason of the fact that the mandrel onto which the paper sleeve is pushed, is also used as the interior mould. The front edge which is opposite the already aforementioned rear edge of the sleeve ought to receive the synthetic plastics lid which is to be moulded onto it. After the paper sleeve has been pushed onto the corresponding mandrel with a closed end face, this leading edge of the sleeve ought to be positioned at a slight distance from the rectangular or quadratic straight edge of the mandrel. In the case of sleeves which have a rectangular cross-section, if the side faces between the four end edges are flat, then injection moulding presents the problem that undesired gaps are created between the correspondingly flat outer surface of the mandrel and the flat side wall of the sleeve into which synthetic plastics material is undesirably forced during injection moulding of the synthetic plastics material for producing the lid on the sleeve. Upon extraction, it is true that such gaps would be favourable for ingress of air but moulding-on must enjoy priority from the production point of view. Therefore, according to the invention, means are provided in order to eliminate these undesired gaps. To form a closure edge in the upper end zone of the mandrel, this latter is at its periphery so constructed that it has a widened out portion. This widened out portion is virtually a kind of bear which extends annularly or strip-like around the periphery of the mandrel. When the paper sleeve is pushed onto the mandrel, it must indeed be pushed beyond the bead or widened-out portion and as already stated, pushing the sleeve onto the mandrel is less of a problem because the paper sleeve, which at this time is open at both ends, is held all round and can therefore be quickly pushed onto the mandrel. At this stage, the widened out portion which extends all round the periphery of the mandrel does not interfere with the formation of the closure edge. But also during withdrawal or downwards movement of the paper sleeve according to the invention, the resistance is not so great but the force exerted on the rear edge of the sleeve via the scraper would be sufficient to push the sleeve smoothly over the bead.

Further advantages, features and possible applications of the present invention will emerge from the following description of a preferred example of embodiment, in conjunction with the attached drawings, in which.

Figure 1:
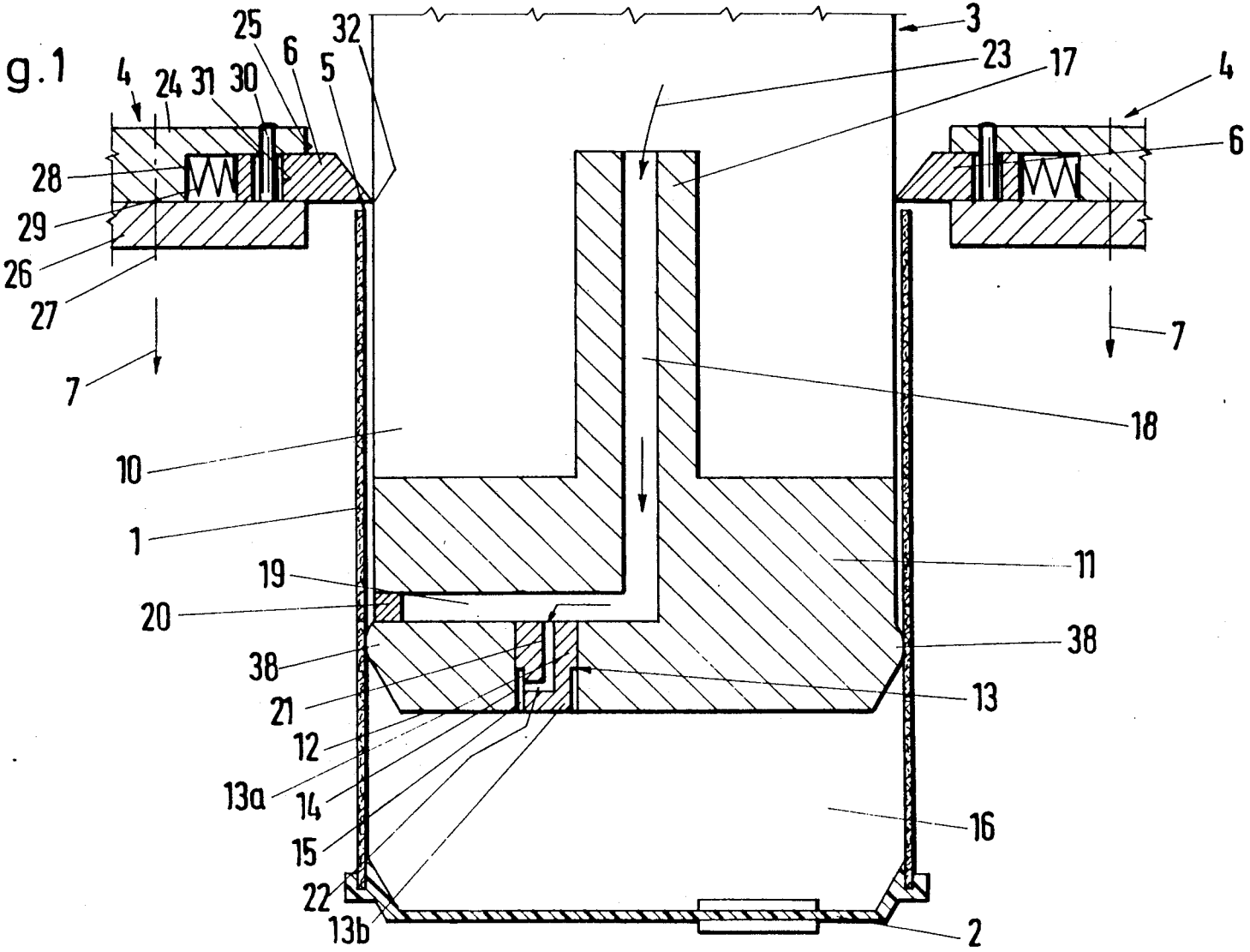
FIG. 1 is a central cross-sectional view through a mandrel with a partly pulled-off paper sleeve, the scraper being shown in a broken away view, the air passages being to a certain extent only diagrammatically indicated.

The sleeve 1 only shown in FIG. 1 has in cross-section a square shape and is closed at one end (at the bottom of FIG. 1) by a lid 2 of synthetic plastics material, with no backing material. In FIG. 1, the sleeve 1 is shown as partly pulled off the mandrel 3 by the scraper 4. The drawing shows the rear edge 5 of the sleeve 1 with which the gripper blocks 6 of the scraper generally designated 4 are engaged. The sleeve 1 moves in the direction of its longitudinal axis due to the translatory movement of the scraper 4 in its direction of translatory movement indicated by the arrow 7; firstly downwardly and subsequently by the same route back and upwardly in the same direction. This direction of movement or conveyance 7 also coincides with the longitudinal axis 8 of the lifting rod 9 shown in FIGS. 2 and 3.

Firstly, it is intended to explain the mandrel 3 in greater detail with reference to FIG. 1. In the direction of its longitudinal axis which coincides with the direction of conveyance 7, it consists of two serially disposed parts, namely the supporting part 10 and the head part 11 by which the closed end face 12 is formed. This end face 12 is described as closed even though an insert 13 is inserted by a screwed joint, the insert 13 consisting of a first inner portion 13*a* of a larger diameter and an outer portion 13*b* of smaller diameter which is intended to be connected directly to the former. The insert 13 may be in one piece, its first part 13*a* carrying an external screwthread not shown here but by means of which the insert 13 is fixed in a bore 14, although other fixing possibilities such as, for example, a press fit, tongue-and-groove, etc., are possible. While the diameter of the bore 14 corresponds to the diameter of the larger first part 13*a*, the diameter 13*b* of the second part of the insert 13 is reduced by twice the width of the circular gap 15, with the result that due to the insert 13 in the bore 14 of relatively large diameter, a circular gap 15 is formed, the width of which is about 0.04 mm. This circular gap 15 forms the air outlet into the space between the injection moulded lid 2 of synthetic plastics material and the closed end face 12 of the mandrel, so that withdrawal of the sleeve 1 in the direction of movement 7 cannot result in any vacuum forming in the space designated 16.

The head part 11 of the mandrel 3 comprises a central rear projection 17 via which the head part 11 is mounted on the supporting part 10 of the mandrel 3 by a screwed connection, a sliding fit or similar fixing means.

The head part 11 is, from the side of its central projection 17, provided with a first air passage 18 which is similarly constructed like a blind bore in the same way as a second air passage 19 which is drilled from the outer periphery of the mandrel or its head part and inwardly being closed on the outside by a plug 20. This plug consists, for instance, of steel and has an external screwthread which is screwed in airtight fashion into the head part 11.

Starting from the second air passage 19 and substantially at right-angles thereto extends the bore 14 into which the insert 13 is fitted, the bore 14 discharging transversely into the end face 12 of the head part 11.

Furthermore, the insert 13 carries a third air passage 21 which communicates with the second air passage 19 in the head part 11, being connected on the opposite side, in the smaller part 13*b* of the insert 13, to a fourth air passage 22 which merges in from the side. This fourth air passage merges on the outside into the circular gap 14 so providing a gas flow connection from the first to the fourth air passage 18, 19, 21, 22 and into the circular gap 15, in fact by means of bores of relatively large diameter which are quite straightforward from the production point of view.

It will be appreciated that also the supporting part 10 of the mandrel 3 is provided with corresponding air supply means although to simplify FIG. 1, they are not shown in the drawings. If reference is merely made to them by stating that, at the upper end of the middle portion 17 in FIG. 1, the curved arrow 23 indicates the direction of air intake, which passes through the first air passage 18, the second air passage 19, the third air passage 21 and the fourth air passage 22 and finally into the annular gap 15 and through it into the space 16 where the vacuum is dissipated when the sleeve 1 is removed from the mandrel 3.

Figure 2:
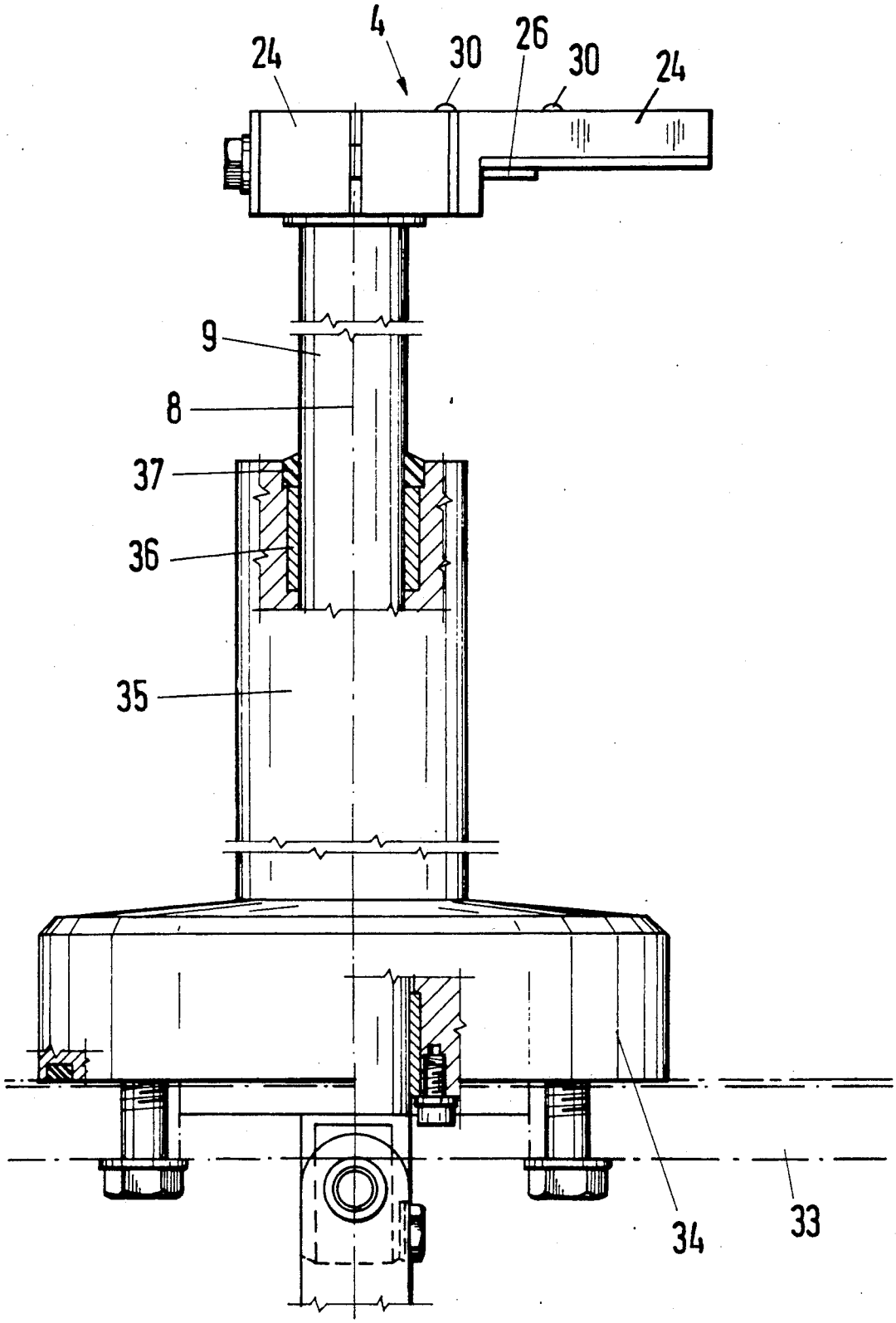
FIG. 2 shows a partly broken away side view of the scraper with a lifting rod and carrier.
Figure 3:
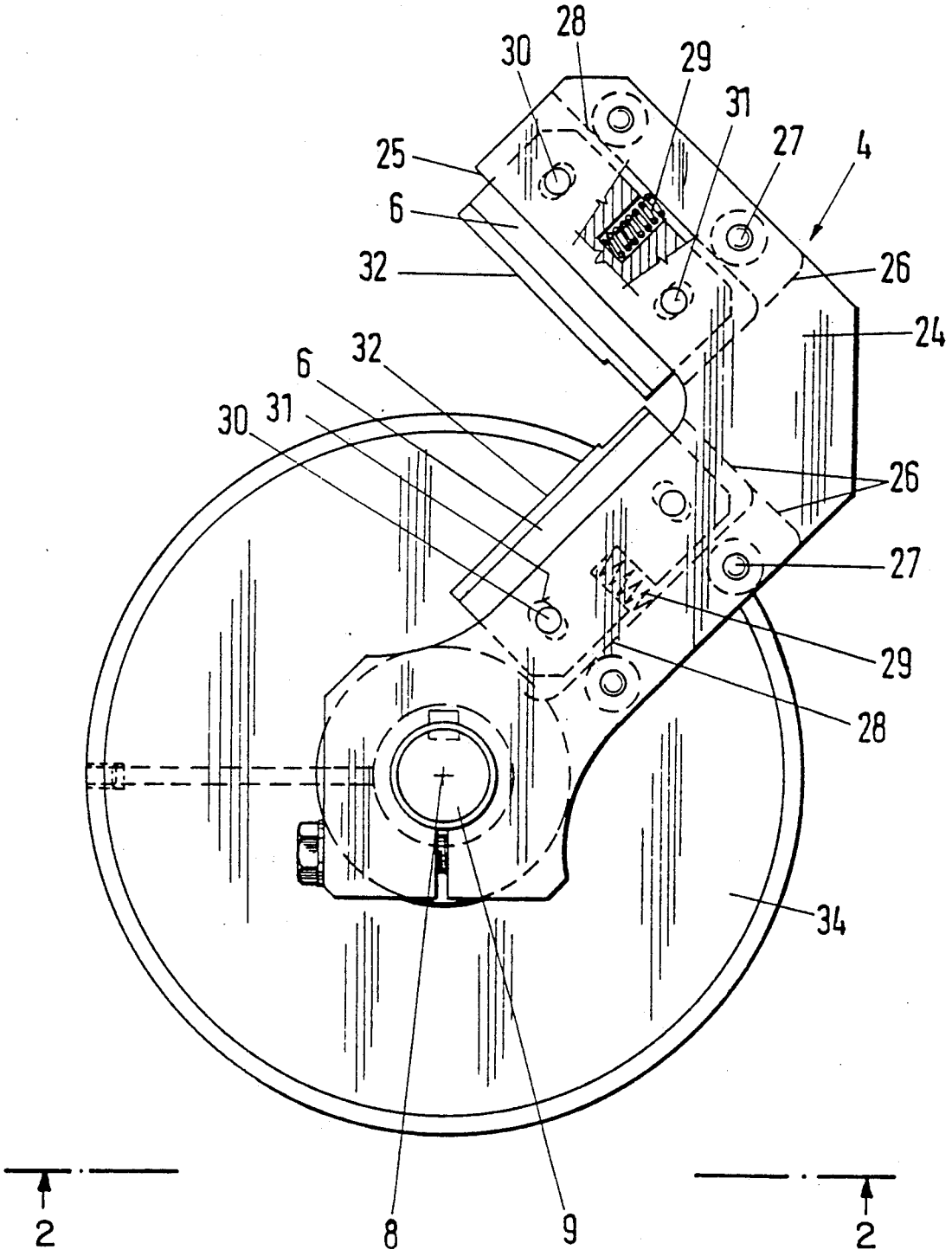
FIG. 3 shows a plan view of the lifting rod with the carrier and the gripper blocks, looking in the direction of the longitudinal axis of the lifting rod from its free end and in the direction of its fixing end.
Figure 4:
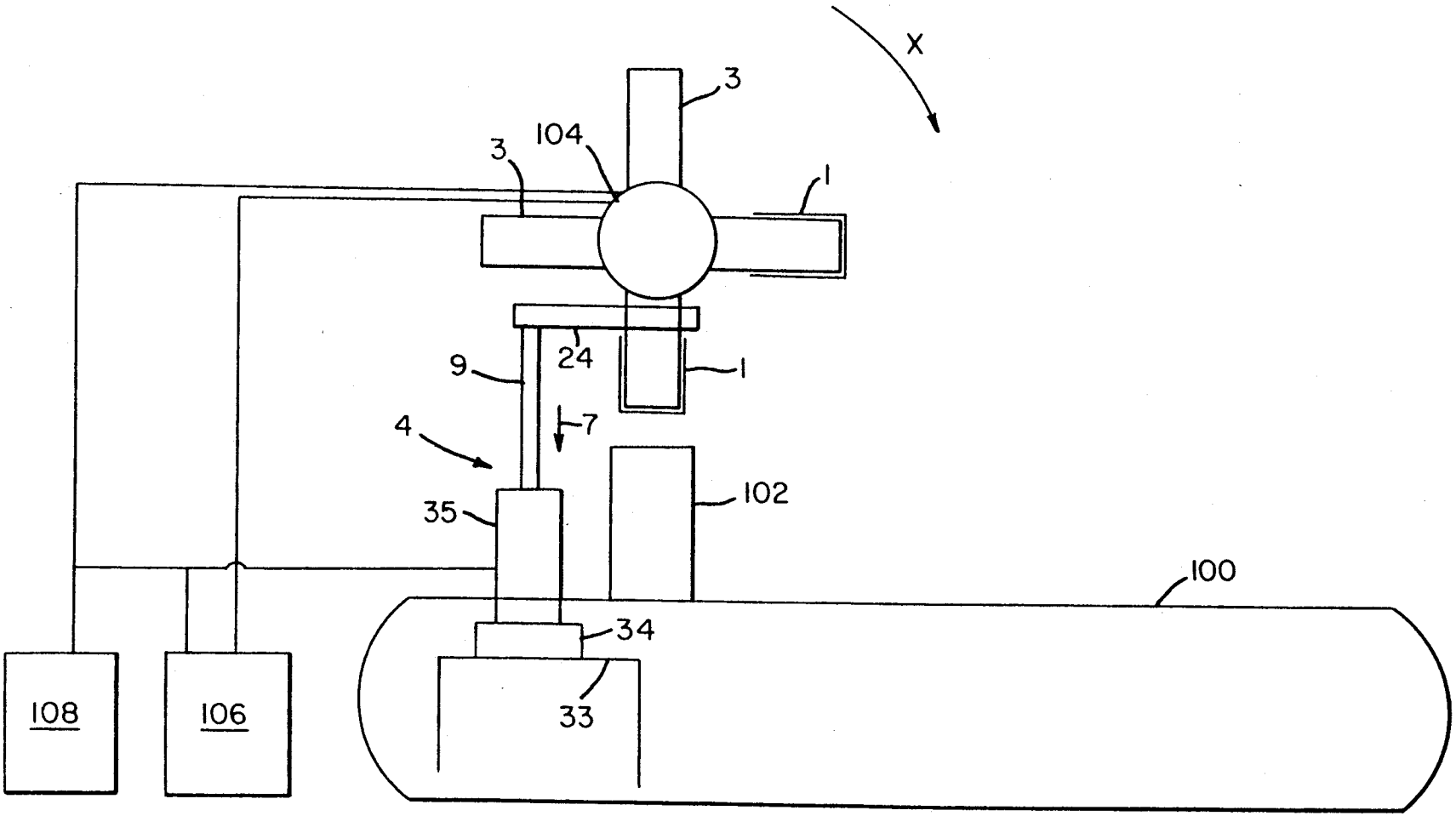
FIG. 4 is a front elevational schematic view of apparatus showing aspects of the invention in a starting position in conjunction with a conveyor system.

While the transporter means 100 may be regarded as a horizontally extending chain conveyor belt or such like, which is shown in FIG. 4 of the drawings, nevertheless FIG. 1 already shows the scraper generally designated 4 which in plan view as shown in FIG. 3 is V-shaped and comprises, constructed as an angle member, a carrier 24, from the inner edges 25 of which, a space is milled in order to accommodate the gripper block 6, the space being closed from underneath by the retaining plate 26. In FIG. 1, only the outer contours of the retaining plate are identified by the broken lines and the reference number 26. In FIG. 2, which is a view of the apparatus according to the line II—II in FIG. 3, one sees the retaining plate 26 with its last end piece. It is mounted on the carrier 24 by means of screws 27. The broken lines 28 which extend lengthwise of the inner edges 25 in FIG. 3 show the rear end of the milled-out space for accommodating the gripper blocks 6. Braced against this rear wall 28 there is a centrally disposed spring 29 which lies in a cylindrical recess in the gripper block 6, possibly being braced against the gripper block. Thus, the gripper block is resiliently pretensioned, being furthermore being fixed by guide pegs 30 provided on the carrier 24, so that the relevant guide journal 30 projects in each case into an elongated hole 31, the longitudinal extension of which is parallel with the central axis of the spring 29 and at right-angles to the plane of the relevant inner edge 25. Thus, each gripper block 6 is movable in relation to the inner edge 25 and, in fact, in the case of the example of embodiment shown in the drawings, it can be moved at right-angles thereto. From the outside, the spring 29 pushes the gripper block 6 inwardly beyond the inner edge 25 and into the space formed by the arms of the V of the inner edge 25. In operation, on the other hand, the mandrel 3 which is not shown in FIGS. 2 and 3, presses against the force of the spring 29 and moves the gripper block 6 transversely to the inner edge 25 and into the space (indicated by the broken line 28 in FIG. 3) in the carrier 24, forcing together the springs 29. Due to this force and counterforce, the front edge 32 of the gripper block 4 always rests against the flat surface of the mandrel 3 therefore gripping, according to the top left view in FIG. 1, the rear edge 5 of the sleeve 1 reliably and with security when the gripper block 6 is moved downwardly in the direction of conveyance 7.

Figure 5:
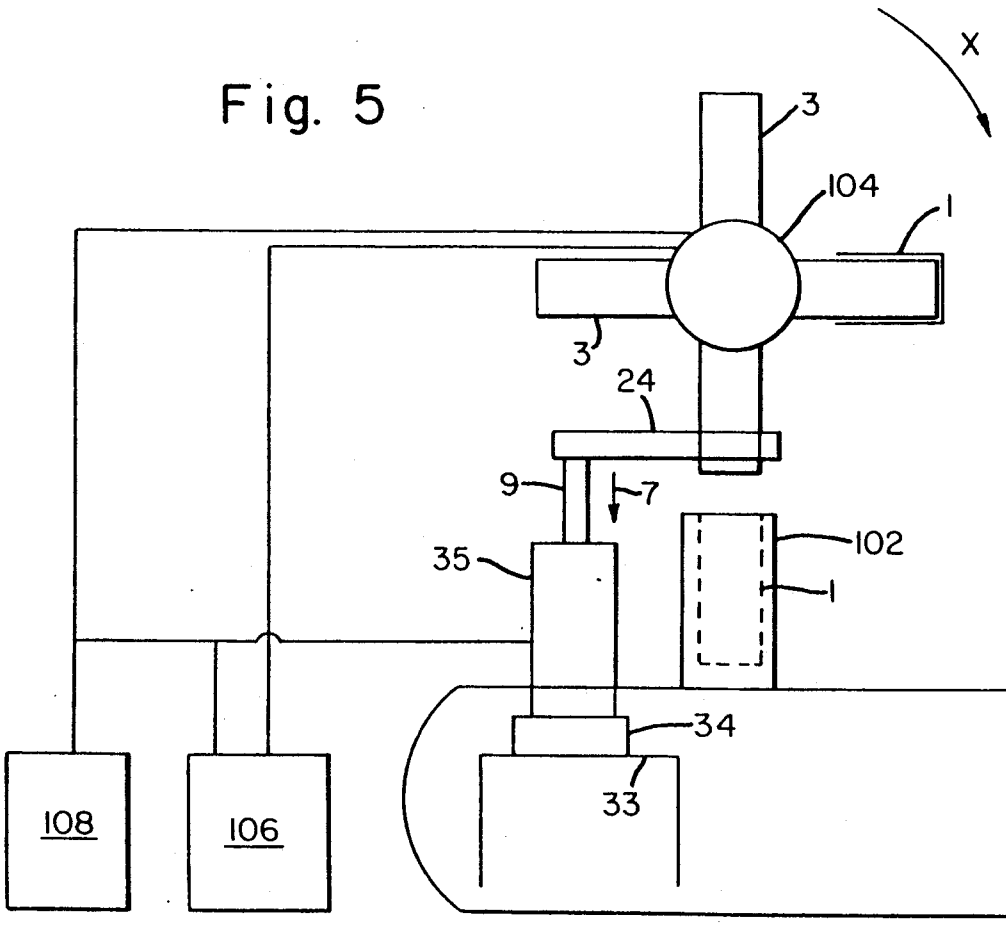
FIG. 5 is a front elevational schematic view of apparatus showing aspects of the invention in a second position in conjunction with a conveyor system.

The translatory movement firstly in the direction of the arrow 7 in FIG. 1 downwardly in order to wipe the sleeve 1 off the mandrel 3 as shown in FIG. 5 and then back upwardly in the same direction in order to move the scraper 4 back to its starting position as shown in FIG. 4 (in FIG. 1 this is the topmost position, now shown) takes place via the driven lifting rod 9 which is moved upwardly and downwardly via drive levers not shown in greater detail, in the direction of its longitudinal axis 8. The lifting rod 9 runs thereby within the fixing 34 provided on the table 33, in the sleeve 35 which is shown in the centre upwards in order to illustrate the sliding bearing 36 and the seal 37.

FIG. 1 furthermore shows at the periphery of the mandrel 3 in the region of its closed end face the bead-like widened-out portion 38 with which the closing edge is formed towards the sleeve 1 when this is pushed into its end position, not shown, in which the mandrel 3 forms the inner shape against which there is pressed and clamped a two-part outer mould which is not shown.

Figure 6:
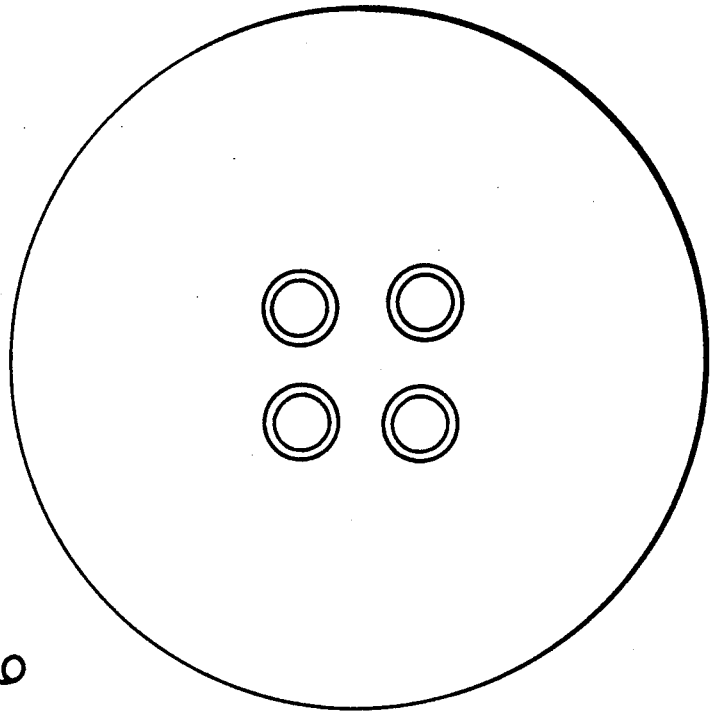
FIG. 6 is a schematic end view of a mandrel having multiple air inlets.

In operation, as illustrated in FIGS. 1, 4 and 5, it is expedient to use a mandrel wheel 104 provided with four mandrels 3 which project outwardly from an axis of rotation, the wheel rotating intermittently. A first mandrel 4 with a sleeve 1 is rotated in the direction shown by arrow X into the starting position in which the longitudinal central axis of the mandrel 3 is in the position shown in FIG. 1. In this position, the scraper 4 can be moved upwardly into its topmost or starting positions by the extension of the lifting rod 9 according to FIG. 2. The gripper 2 has its edge 32 (two grippers) bearing against the flat surface of the mandrel 3. Now starts the downwards movement of the lifting rod 9 in the direction of conveyance of the arrow 7. The front edge 32 of the gripper block 16 grips two of the four straight rear edges 5 of the sleeve 1 and moves it downwardly, from the space 16. Air, supplied by blower 106 is blown into this space through the air passages 18, 19, 21, 22 and the circular gap 15 so that no vacuum can be created and so that the sleeve 1 can be pulled quickly down off the mandrel 3 while the lifting rod 9 moves into the sleeve 35. FIG. 6 shows several circular gaps 15 through which air is blown from the air passages. While this is happening, the scraped-off paper sleeve moves from the mandrel 3 into a transport basket 102 disposed at a distance from and below the mandrel 3, in the direction of conveyance 7, the transport basket 102 being moved into the transporter means 100. Now the extreme end position has been reached.

The drive reverses the movement of the lifting rod 9. The lifting rod 9 now moves in the direction of its longitudinal axis 8 upwardly according to FIG. 2, i.e. against the direction of view in FIG. 1. While this is happening, the mandrel wheel so rotates in a counter clockwise direction, when looking at FIG. 1, that the free mandrel 3 continues to move rightwards and upwardly, while a new mandrel 3 carrying a further paper sleeve 1 is rotated from the left upwards into the position shown in FIG. 1. The fact that while this is happening the scraper 4 with the V-shaped angular carrier 25 is moved upwardly in the direction opposite the direction of conveyance 7 does not interfere with attainment of the starting position of the mandrel 3. Then the cycle begins again.

Control system 108 is connected to coordinate rotation of mandrel wheel 104, scraper 4, transporter 100 and blower 106 as shown in FIGS. 4 and 5.

I claim:

1. Apparatus for conveying plastics coated paper or cardboard sleeves having one end closed by a plastic lid molded thereto from a mandrel to a transporter in sequence, comprising:

a mandrel wheel having a multiplicity of mandrels extending radially outwardly therefrom, said mandrels having proximal and distal ends, said distal ends having end faces and widened out portions adjacent said end faces;

air blowing means connected to said mandrel wheel;

an air blowing passageway extending through said mandrels and connected to said air blowing means;

at least one end face insert forming an air outlet on the face of each of said mandrels, said inserts being connected to said passageway;

a scraper located adjacent one of said mandrels located in a starting position, said scraper being positioned to engage each of said mandrels and including at least a base member, a reciprocable lifting rod and scraper arm, said lifting rod being capable of reciprocating in a direction parallel to an axis extending through said mandrel in said starting position, said scraper arm having means biased perpendicularly to said axis and into contact with said mandrel positioned closest to said scraper, and being reciprocable in conjunction with said lifting rod to engage a sleeve on said mandrel in said starting position;

control means connected to rotate said mandrel wheel to receive sleeves on said mandrels and to position said mandrels adjacent said scraper, to reciprocate said lifting rod and said scraper arm from said proximal end to said distal end of said mandrels and substantially simultaneously to blow air through said air outlets and to reciprocate said lifting rod from said distal end to said proximate end of said mandrels.

2. Apparatus according to claim 1 wherein said scraper arm has a V-shaped portion which engages said sleeves.

3. Apparatus according to claim 2 wherein said V-shaped portion includes two spring loaded gripper blocks adapted for movement at right-angles to an inner edge of said V-shape.

4. Apparatus according to claim 1 wherein said air outlets have diameters less than or equal to 0.05 mm.

5. Apparatus according to claim 1 wherein said widened out portions are bead shaped.

* * * * *